US005964532A

United States Patent [19]

St. Phillips et al.

[11] Patent Number: 5,964,532

[45] Date of Patent: Oct. 12, 1999

[54] RECLOSABLE FASTENER STRIP WITH TAMPER EVIDENT FEATURE

[75] Inventors: Eric A. St. Phillips, Fairport; Toby R. Thomas, Pittsford; Alex R. Provan, Canandaigua, all of N.Y.

[73] Assignee: Tenneco Packaging Inc., Lake Forest, Ill.

[21] Appl. No.: 08/950,535

[22] Filed: Oct. 15, 1997

Related U.S. Application Data

[63] Continuation of application No. 08/694,093, Aug. 7, 1996, abandoned.

[51] Int. Cl.[6] ..... B65D 33/34

[52] U.S. Cl. ..... 383/5; 383/61; 383/64; 383/203; 383/207

[58] Field of Search ..... 383/5, 61, 63, 383/64, 65, 203, 204, 207, 209

[56] References Cited

U.S. PATENT DOCUMENTS

| | | | |
|---|---|---|---|
| Re. 33,674 | 8/1991 | Uramoto . | |
| Re. 34,554 | 3/1994 | Ausnit . | |
| 1,992,152 | 2/1935 | Yeates . | |
| 2,506,311 | 5/1950 | Moore . | |
| 2,560,535 | 7/1951 | Allen . | |
| 2,898,027 | 8/1959 | Scholle . | |
| 2,978,769 | 4/1961 | Harrah . | |
| 3,104,798 | 9/1963 | Stone . | |
| 3,172,443 | 3/1965 | Ausnit . | |
| 3,181,583 | 5/1965 | Lingenfelter . | |
| 3,198,228 | 8/1965 | Naito . | |
| 3,282,493 | 11/1966 | Kamins et al. . | |
| 3,313,471 | 4/1967 | Dickard et al. . | |
| 3,325,084 | 6/1967 | Ausnit . | |
| 3,326,399 | 6/1967 | Ausnit . | |
| 3,387,640 | 6/1968 | Butler . | |
| 3,456,867 | 7/1969 | Repko . | |
| 3,462,068 | 8/1969 | Suominen . | |
| 3,471,005 | 10/1969 | Sexstone . | |
| 3,473,589 | 10/1969 | Gotz . | |
| 3,543,343 | 12/1970 | Staller et al. . | |
| 3,625,270 | 12/1971 | Skendzic . | |
| 3,633,642 | 1/1972 | Siegel | 383/64 |
| 3,746,215 | 7/1973 | Ausnit et al. . | |
| 3,780,781 | 12/1973 | Uramoto . | |
| 3,991,801 | 11/1976 | Ausnit | 383/61 |
| 4,189,050 | 2/1980 | Jensen et al. | 206/245 |
| 4,191,230 | 3/1980 | Ausnit | 383/61 |
| 4,196,030 | 4/1980 | Ausnit | 156/91 |
| 4,235,653 | 11/1980 | Ausnit | 156/91 |

(List continued on next page.)

FOREIGN PATENT DOCUMENTS

| | | |
|---|---|---|
| 87302342 | 3/1987 | European Pat. Off. . |
| 57-105248 | 6/1982 | Japan . |
| 2130173 | 10/1983 | United Kingdom . |
| WO95/29604 | 11/1995 | WIPO . |
| WO95/35046 | 12/1995 | WIPO . |
| WO95/35047 | 12/1995 | WIPO . |
| WO95/35048 | 12/1995 | WIPO . |

*Primary Examiner*—Jes F. Pascua
*Attorney, Agent, or Firm*—Arnold, White & Durkee

[57] ABSTRACT

A reclosable package comprises opposing wall panels and a reclosable seal. The opposing wall panels are joined on three sides such as to create a receptacle space having a mouth at one end. The reclosable seal extends along the one end and including a first track and a second track. The first track includes a first reclosable element and a first fin portion extending downward from the first reclosable element toward the receptacle space. The first track is joined to one of the wall panels. The second track includes a second reclosable element and a second fin portion extending downward from the second reclosable element toward the receptacle space. The second track is joined to the other of the wall panels. The first and second reclosable elements are releasably engageable to each other. In one embodiment, the first and second fin portions are joined to each other along a one-time breakable preferential area of weakness to prevent tampering with the package prior to being opened. In another embodiment, the mouth end is pleated and forms a one-time breakable preferential area of weakness.

8 Claims, 3 Drawing Sheets

U.S. PATENT DOCUMENTS 4,241,865 12/1980 Ferrell ..... 229/62
4,249,982 2/1981 Ausnit ..... 156/461
4,252,238 2/1981 Spiegelberg et al. ..... 206/210
4,285,376 8/1981 Ausnit ..... 383/61
4,428,477 1/1984 Cristofolo ..... 206/210
4,518,087 5/1985 Goglio ..... 206/632
4,573,203 2/1986 Peppiatt ..... 383/8
4,617,683 10/1986 Christoff ..... 383/63
4,713,839 12/1987 Peppiatt ..... 383/61 X
4,736,450 4/1988 Van Erden et al. ..... 383/65
4,744,674 5/1988 Nocek ..... 383/63
4,782,951 11/1988 Griesbach et al. ..... 206/484
4,786,190 11/1988 Van Erden et al. ..... 383/61
4,791,710 12/1988 Nocek et al. ..... 383/5 X
4,846,585 7/1989 Boeckmann et al. ..... 383/5
4,877,336 10/1989 Peppiatt ..... 383/63 X
4,923,309 5/1990 VanErden ..... 383/5
4,925,316 5/1990 Van Erden et al. ..... 383/63 X
5,007,142 4/1991 Herrington ..... 24/400
5,007,143 4/1991 Herrington ..... 24/400
5,010,627 4/1991 Herrington et al. .
5,020,194 6/1991 Herrington et al. .
5,023,122 6/1991 Boeckmann et al. .
5,033,868 7/1991 Peppiatt .
5,063,644 11/1991 Herrington et al. .
5,067,208 11/1991 Herrington, Jr. et al. .
5,070,583 12/1991 Herrington .
5,088,971 2/1992 Herrington .
5,092,684 3/1992 Weeks .
5,092,831 3/1992 James et al. .
5,100,246 3/1992 La Pierre et al. .
5,112,138 5/1992 Peppiatt .
5,116,301 5/1992 Robinson et al. .
5,121,997 6/1992 LaPierre et al. .
5,129,734 7/1992 Van Erden .
5,131,121 7/1992 Herrington, Jr. et al. .
5,152,613 10/1992 Herrington, Jr. .
5,161,286 11/1992 Herrington, Jr. et al. .
5,186,543 2/1993 Cochran .
5,189,764 3/1993 Herrington et al. .
5,211,482 5/1993 Tilman .
5,224,779 7/1993 Thompson et al. .
5,283,932 2/1994 Richardson et al. .
5,301,394 4/1994 Richardson et al. .
5,301,395 4/1994 Richardson et al. .
5,405,478 4/1995 Richardson et al. .
5,425,825 6/1995 Rasko et al. .
5,426,830 6/1995 Richardson et al. .
5,431,760 7/1995 Donovan .
5,435,864 7/1995 Machacek et al. .
5,442,837 8/1995 Morgan .
5,442,838 8/1995 Richardson et al. .
5,448,807 9/1995 Herrington, Jr. .
5,448,808 9/1995 Gross .
5,456,928 10/1995 Hustad et al. .
5,482,375 1/1996 Richardson et al. .
5,669,715 9/1997 Dobreski et al. ..... 383/204 X
5,682,730 11/1997 Dobreski .

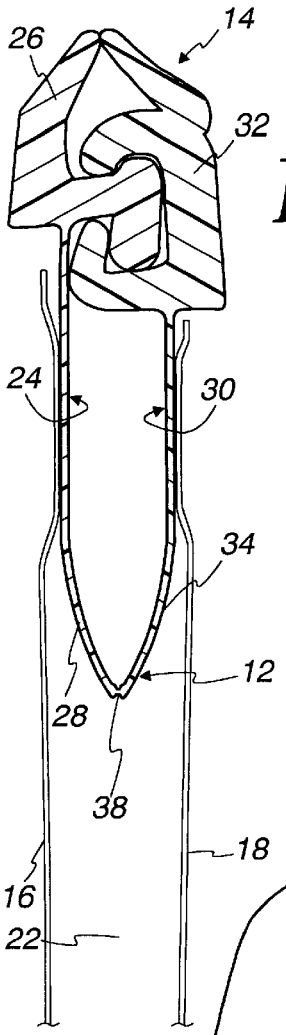
Fig. 1
Fig. 2
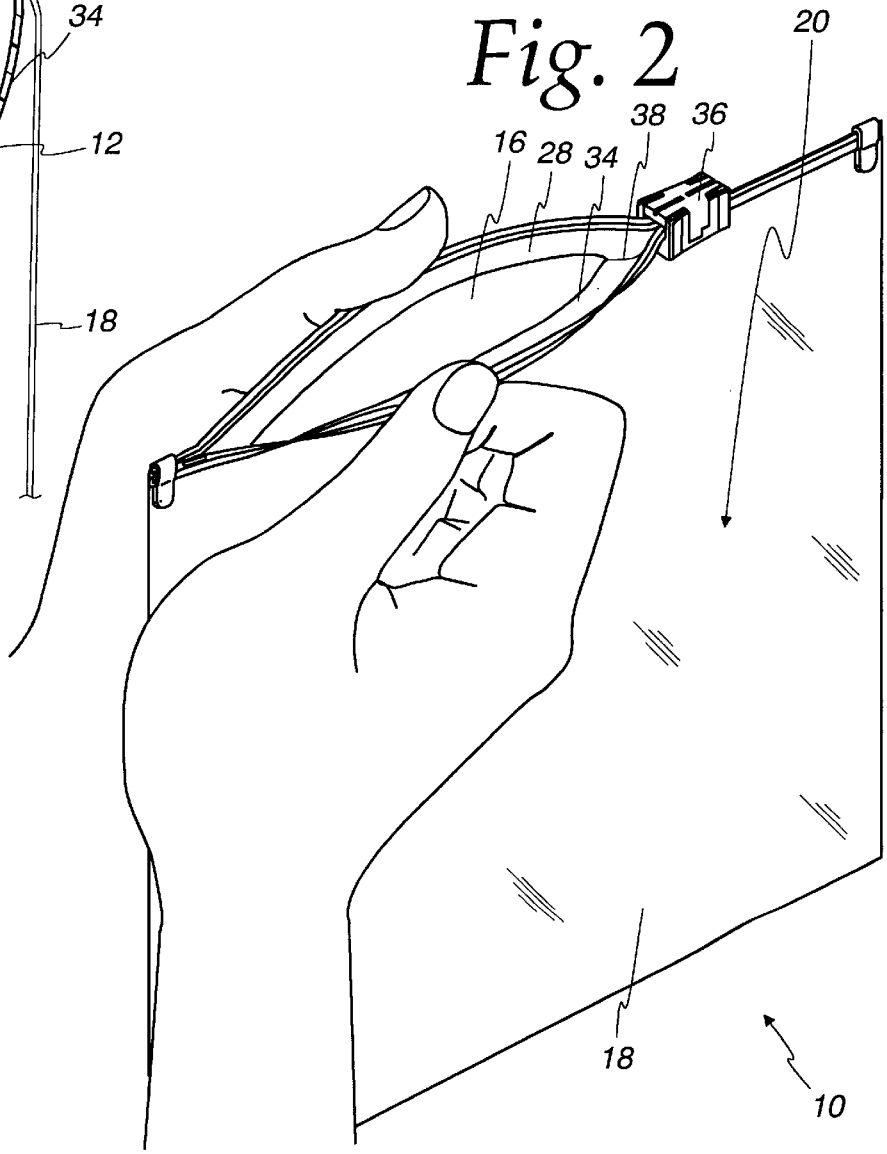

Fig. 5
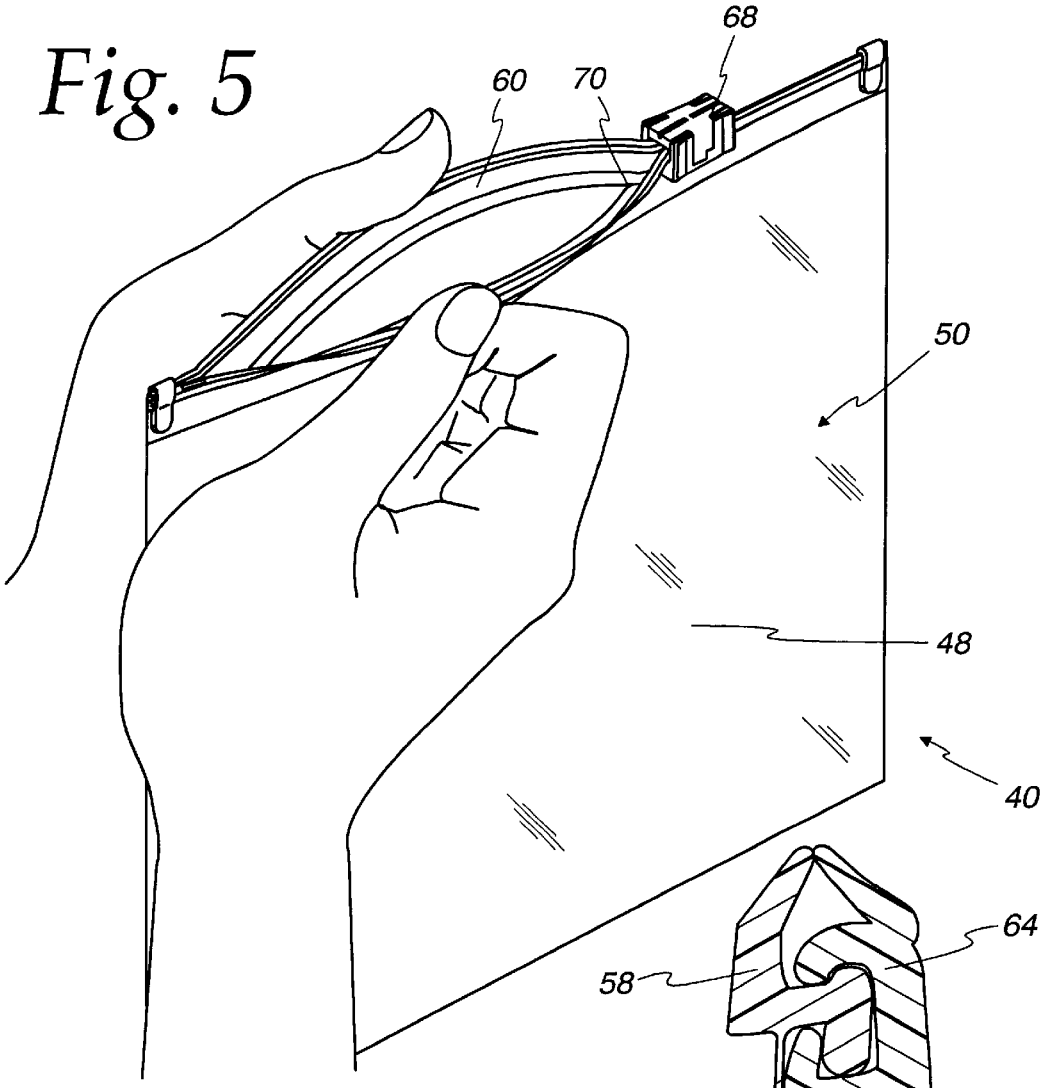
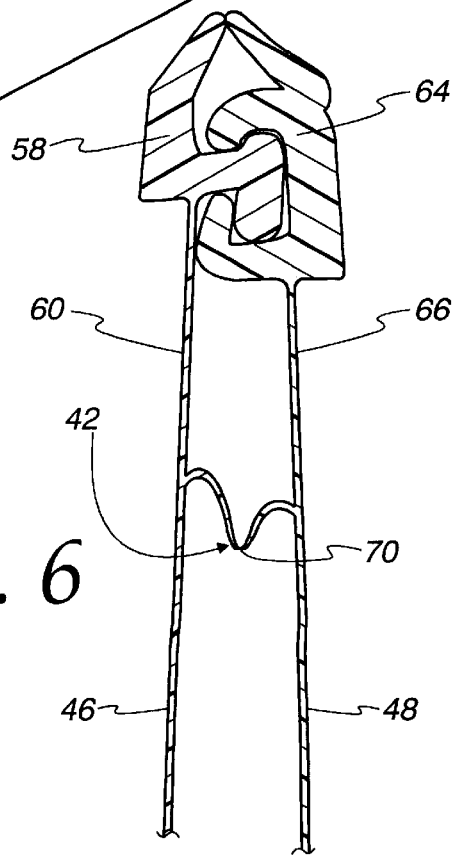
Fig. 6

RECLOSABLE FASTENER STRIP WITH TAMPER EVIDENT FEATURE

This application is a continuation of Ser. No. 08/694,093, filed Aug. 8, 1996, now abandoned.

FIELD OF THE INVENTION

The present invention relates generally to the packaging industry. More particularly, the invention relates to a reclosable package having a tamper evident feature.

BACKGROUND OF THE INVENTION

Reclosable packages are very common, especially in the food industry. Such packages are typically made to be reclosable via the use of a reclosable feature such as a resealable adhesive seal or a reclosable zipper. Such zippers can be opened and closed either by pressure or by the use of an auxiliary slider mechanism.

Reclosable packages are a great convenience to the consumer especially for products such as luncheon meats and cheeses where, typically, only a portion of the product is used at any given time. A problem with these reclosable packages, however, is that the reclosable features do not provide a leak proof barrier. Thus, the contents of the package can leak out of the package and the external atmosphere can leak into the package, promoting food spoilage. Another problem with reclosable packages is that such packages can be easily tampered with prior to purchase by the consumer.

A need therefore exists for packages having a leak and tamper proof seal in addition to having a reclosable feature. It would be especially advantageous to place such a leak and tamper proof seal below the reclosable feature (closer to the food product) such that the tamper proof seal would not in any way interfere with the operation of the reclosable feature.

SUMMARY OF THE INVENTION

The present invention is directed to a reclosable package having a tamper evident seal located below the reclosable feature of the package.

In one embodiment, a reclosable package comprises opposing wall panels and a reclosable seal. The opposing wall panels are joined on three sides such as to create a receptacle space having a mouth at one end. The reclosable seal extends along the one end and including a first track and a second track. The first track includes a first reclosable element and a first fin portion extending downward from the first reclosable element toward the receptacle space. The first reclosable element or the first fin portion is coupled to one of the wall panels. The second track includes a second reclosable element and a second fin portion extending downward from the second reclosable element toward the receptacle space. The second reclosable element or the second fin portion is coupled to the other of the wall panels. The first and second reclosable elements are releasably engageable to each other. The first and second fin portions are joined to each other along a one-time breakable preferential area of weakness to prevent tampering with the package prior to being opened. The first and second fin portions may be coextruded as a single continuous fin or may be separately extruded and then later connected to each other.

In another embodiment, a reclosable package comprises opposing wall panels and a reclosable seal. The opposing wall panels are sealed on four sides with at least one of the four sides being pleated. The pleated side forms a one-time breakable preferential area of weakness. The reclosable seal extends along the pleated side and includes a first track and a second track. The first track includes a first reclosable element and a first fin portion extending downward from the first reclosable element. The first fin portion is connected to one of the wall panels. The second track includes a second reclosable element and a second fin portion extending downward from the second reclosable element. The second fin portion is connected to the other of the wall panels. The first and second reclosable elements are releasably engageable to each other. The first and second fin portions may be coextruded with the respective wall panels or may be separately extruded from the respective wall panels and then later connected thereto.

BRIEF DESCRIPTION OF THE DRAWINGS

Other objects and advantages of the invention will become apparent upon reading the following detailed description and upon reference to the drawings in which:

FIG. 1 is a section view of a mouth portion of a reclosable package having a tamper proof feature formed by joined fin portions located below a reclosable zipper arrangement;

FIG. 2 is a perspective view of the reclosable package incorporating the mouth portion depicted in FIG. 1 in which a reclosable zipper having a slider mechanism is opened and the tamper proof feature formed by joined fins is partially opened;

FIG. 5 is a perspective view of the reclosable package incorporating the mouth portion depicted in FIG. 4 in which a reclosable zipper having a slider mechanism is opened and the tamper proof feature formed by the pleated side is partially opened; and FIG. 6 is a section view of a mouth portion of a reclosable packaging having a modified tamper proof feature formed by a pleated side located below a reclosable zipper arrangement.

Figure 3:
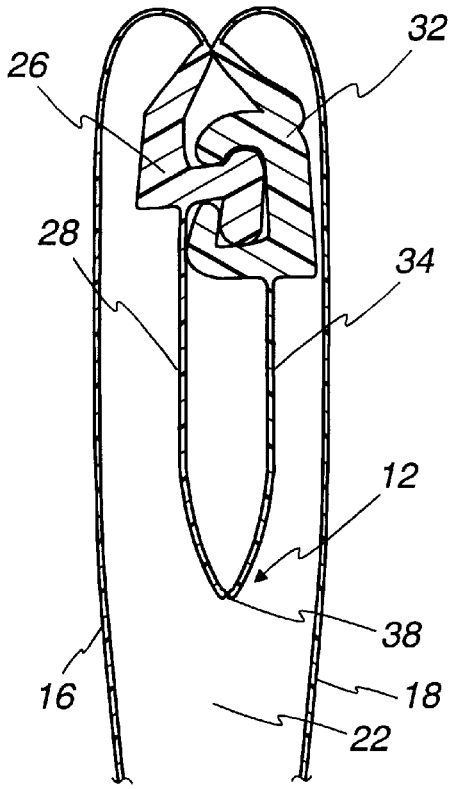
FIG. 3 is a section view of a mouth portion of a reclosable package having modified tamper proof feature formed by joined fin portions located below a reclosable zipper arrangement.

While the invention will be described in connection with certain preferred embodiments, it is not intended to limit the invention to the specific exemplary embodiments. On the contrary, it is intended to cover all alternatives, modifications, and equivalents as may be included within the spirit and scope of the invention as defined by the appended claims.

DESCRIPTION OF THE PREFERRED EMBODIMENTS

Turning now to the drawings, FIG. 1 depicts a mouth portion of a reclosable package having a tamper evident feature 12 located below a reclosable closure arrangement 14. FIG. 2 shows the reclosable package 10 incorporating the mouth portion depicted in FIG. 1. The mouth portion of the reclosable package 10 includes a pair of opposing wall panels 16 and 18 of polymeric film which make up a package body 20 and define a receptacle space 22. Connected to the wall panel 16 is a first track 24 having a first profile 26 and a first fin portion 28 extending downward from the first profile 26. Connected to the other wall panel 18 is a second track 30 having a second profile 32 and a second fin portion 34 extending downward from the second profile 32. The first and second profiles 26 and 32 are releasably engageable with each other to provide a reclosable seal to the package. In the illustrated embodiment, the lower edges of the first and second fin portions 28 and 34 are joined to each other along a one-time breakable preferential area of weakness or preferential tear area 38 to form a one-time openable tamper evident feature. The joined first and second fin portions 28 and 34 have a generally U-shaped or V-shaped cross-sectional configuration.

To join the first and second fin portions 28 and 34, the first and second fin portions 28 and 34 may be coextruded as a single continuous fin having the preferential area of weakness 38. In one embodiment, the preferential area of weakness 38 takes the form of a perforated line, score line, or thinned line. A score line is created by making a uniform crease at the intersection of the fin portions 28 and 34. A thinned line is created by coextruding the fin portions 28 and 34 with less plastic material along the region joining the lower edges of the fin portions 28 and 34. In another embodiment, the preferential area of weakness 38 results from forming the single continuous fin out of highly oriented plastic that has a tendency to split along the preferential area of weakness 38.

Instead of coextruding the first and second fin portions 28 and 34 as a single continuous fin, the first and second fin portions 28 and 34 may be separately extruded and then later weakly attached at their lower edges or some other location by heat sealing, welding, or the like. The weak attachment of the first and second fin portions 28 and 34 creates the preferential area of weakness 38.

The reclosable package 10 further has an auxiliary slider mechanism 36 (FIG. 2) slidably mounted to the closure arrangement 14 for movement between a closed position and an open position. The first and second profiles 26 and 32 are engaged to each other while the slider mechanism 36 is in the closed position, and movement of the slider mechanism 36 from the closed position to the open position disengages the profiles 26 and 32 from each other. The composition and manner of operation of this zipper and slider arrangement is described in detail in U.S. Pat. No. 5,067,208 to Herrington, Jr. et. al., which is incorporated herein by reference in its entirety.

As illustrated in FIG. 2, in order to open the reclosable package of the instant invention, the consumer grips the slider mechanism 36 and moves it such that the closure profiles 26 and 32 of the respective first and second tracks 24 and 30 are detached from each other. Next, the consumer tears open the tamper evident feature along the preferential area of weakness 38 joining the lower edges of the first and second fin portions 28 and 34. The package can be resealed utilizing the reclosable closure arrangement 14 and slider mechanism 36. Specifically, the consumer grips the slider mechanism 36 and moves it from the open position to the closed position so as to engage the complementary closure profiles 26 and 32.

In an alternative embodiment depicted in FIG. 3, where like reference numerals are used to designate analogous parts, the first wall panel 16 is integrally formed with an upper edge of the closure profile 26 such that the outer surface of the first fin portion 28 need not be connected to the first wall panel 16. Likewise, the second wall panel 18 is integrally formed with an upper edge of the closure profile 32 such that the outer surface of the second fin portion 28 need not be connected to the second wall panel 18.

Figure 4:
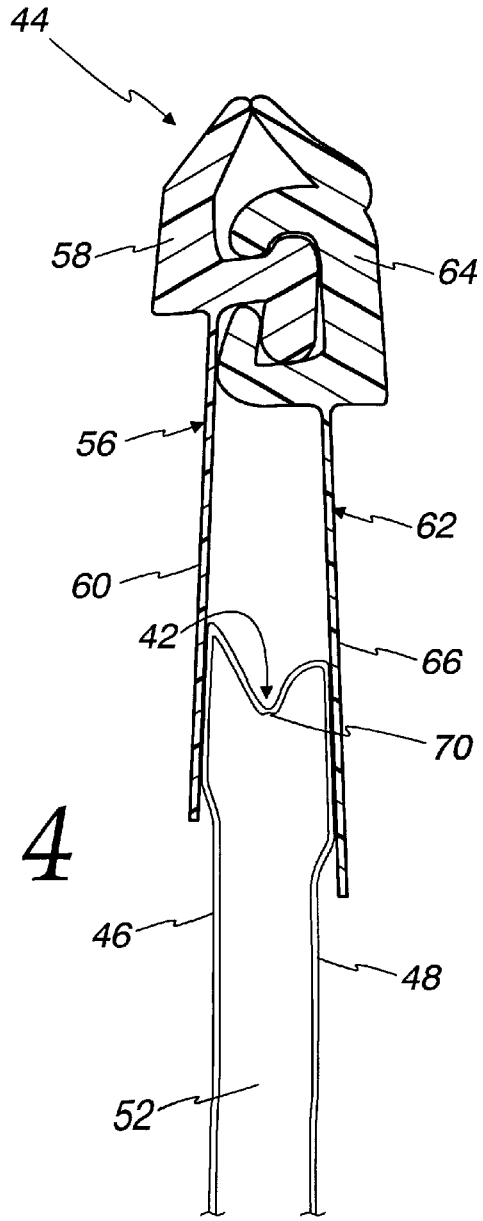
FIG. 4 is a section view of a mouth portion of an alternative reclosable package having a tamper proof feature formed by a pleated side located below a reclosable zipper arrangement.

FIGS. 4 and 5 show an alternative embodiment of the instant invention. FIG. 4 shows a section view of a mouth portion of a reclosable package 40 depicted in FIG. 5. The reclosable package 40 includes a tamper evident feature 42 located below a reclosable closure arrangement 44. The reclosable package 40 includes a pair of opposing wall panels 46 and 48 of polymeric film which make a package body 50 and define a receptacle space 52. The mouth end of the package 40 where the opposing wall panels 46 and 48 are sealed to each other is pleated. The pleat, which has a generally M-shaped cross-sectional configuration, forms the tamper proof feature 42 located below the reclosable closure arrangement 44. More specifically, the center region of the pleat is a one-time breakable preferential area of weakness 70. Connected to the wall panel 46 is a first track 56 having a first profile 58 and a first fin portion 60 extending downward from the first profile 58. Connected to the other wall panel 48 is a second track 62 having a second profile 64 and a second fin portion 66 extending downward from the second profile 64. The first and second profiles 58 and 64 are releasably engageable with each other to provide a reclosable seal to the package.

The reclosable package 40 further has an auxiliary slider mechanism 68. As illustrated in FIG. 5, in order to open the reclosable package 40, the consumer grips the slider mechanism 68 and moves it from a closed position to an open position so as to disengage the closure profiles 58 and 64 from each other. Next, the consumer tears open the tamper evident feature along the preferential area of weakness 70, which may take any of the forms described in connection with FIGS. 1 and 2. The package can be resealed utilizing the reclosable closure arrangement 44 and slider mechanism 68. Specifically, the consumer grips the slider mechanism 68 and moves it from the open position to the closed position so as to engage the complementary closure profiles 58 and 64.

In an alternative embodiment depicted in FIG. 6, where like reference numerals are used to designate analogous parts, the first and second fin portions 60 and 66 are coextruded with the respective wall panels 46 and 48.

FIGS. 1–6 depict alternative embodiments of packages having both a tamper evident feature as well as a reclosable closure arrangement. The tamper evident feature not only provides a consumer with the assurance that his or her newly purchased package has never been opened before, but also provides a very good initial seal which preserves the freshness of the food contents of the package prior to its initial opening. Since the reclosable closure arrangement is located above the tamper evident feature, the operation of the reclosable closure arrangement is not hampered by the presence of the tamper evident feature.

The interlocking profiles, tracks, fin portions, and optional slider mechanism are optimally made from polyethylene, polypropylene, or copolymers of polyethylene or polypropylene. Especially preferred components are low density polyethylene (LDPE) and LDPE/polypropylene mixtures.

The opposing films making up the opposing wall panels of the polymeric package typically are made of polyethylene, polypropylene, polyester, copolyester or mixtures of those compositions. Furthermore, the polymeric packages of the present invention can have multiple layers joined by coextrusion. Thus, one skilled in the art can design and coextrude multi-layered polymeric bags which will incorporate the various properties inherent in differing polyethylene and polypropylene compositions. It is further possible to incorporate pigments, metallic components, paper, and/or paper/plastic composites into or on the layer or layers of the polymeric bags of the instant invention.

The components of the reclosable closure arrangement such as the tracks having integrally formed interlocking profiles and fin portions may be attached to the package films making up the wall panels of the package by the processes of either heat sealing or welding. The process utilized depends upon the materials from which the bag and closure arrangements are made. Specifically, heat sealing is a process whereby similar polymeric-based materials are fused or melted together. Welding is a process where an intermediate third material such as an adhesive is utilized to "glue" dissimilar polymeric-based materials to each other.

Alternatively, an adhesive seal may be utilized as the reclosable feature of the instant invention. Such seals employ a resealable adhesive-type substance which is applied to either one or both of the films making up the polymeric package. Alternatively, the adhesive is applied to an intermediary base strip.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A reclosable package comprising:

opposing wall panels joined on three sides such as to create a receptacle space having a mouth at one end; and a reclosable seal extending along said one end and including a first track and a second track, said first track including a first reclosable element and a first fin portion extending downward from said first reclosable element toward said receptacle space, said second track including a second reclosable element and a second fin portion extending downward from said second reclosable element toward said receptacle space, said first and second fin portions being joined to each other along a one-time breakable preferential area of weakness to prevent tampering with said package prior to being opened, said reclosable seal being free of pull flanges extending upward from said first and second reclosable elements which can be grasped and pulled apart to open said reclosable seal from a sealed form; and a slider mechanism slidably mounted to said reclosable seal for movement between a closed position and an open position, said first and second reclosable elements being engaged to each other while said slider mechanism is in said closed position, said first and second reclosable elements being disengaged from each other in response to movement of said slider mechanism to said open position.

2. The reclosable package of claim 1, wherein said first and second fin portions are joined to each other along respective lower edges thereof.

3. The reclosable package of claim 1, wherein said first and second fin portions are coextruded with each other so as to form a single continuous fin.

4. The reclosable package of claim 1, wherein a combination of said first and second fin portions has a generally U-shaped or V-shaped cross-sectional configuration.

5. The reclosable package of claim 1, wherein said first fin portion is attached to an inner surface of said one of said walls and said second fin portion is attached to an inner surface of said other of said walls.

6. The reclosable package of claim 1, wherein said preferential area of weakness is selected from the group consisting of a series of perforations, a score line, a thinned line, and a highly oriented region.

7. The reclosable package of claim 1, wherein said first fin portion is directly connected to one of said wall panels and said second fin portion is directly connected to the other of said wall panels.

8. The reclosable package of claim 1, wherein said first reclosable element is directly connected to one of said wall panels and said second reclosable element is directly connected to the other of said wall panels.

* * * * *